US005472184A

United States Patent [19]

Focke et al.

[11] Patent Number: 5,472,184

[45] Date of Patent: Dec. 5, 1995

[54] APPARATUS FOR THE STORAGE AND EXTRACTION OF BLANKS

[75] Inventors: Heinz Focke, Verden; Henry Buse, Visselhövede, both of Germany

[73] Assignee: Focke & Co. (GmbH & Co.), Verden, Germany

[21] Appl. No.: 128,961

[22] Filed: Sep. 30, 1993

[30] Foreign Application Priority Data

Oct. 13, 1992 [DE] Germany ..... 42 34 377.1

[51] Int. Cl.[6] ..... B65H 5/08

[52] U.S. Cl. ..... 271/11; 271/93; 271/95; 271/99; 271/104

[58] Field of Search ..... 271/11, 91, 93, 271/94, 95, 99, 104

[56] References Cited

U.S. PATENT DOCUMENTS

| | | | |
|---|---|---|---|
| 4,114,872 | 9/1978 | Davies et al. | 271/91 |
| 5,169,285 | 12/1992 | Muller | 271/91 X |

FOREIGN PATENT DOCUMENTS

| | | | |
|---|---|---|---|
| 0332828 | 9/1989 | European Pat. Off. | 271/95 |
| 2348134 | 11/1977 | France . | |
| 2350289 | 12/1977 | France . | |
| 1060701 | 12/1959 | Germany . | |
| 2436354 | 2/1976 | Germany . | |
| 2110963 | 4/1977 | Germany . | |
| 2718842 | 11/1977 | Germany . | |
| 2722749 | 12/1977 | Germany . | |
| 3046280 | 6/1982 | Germany . | |
| 405368 | 7/1966 | Switzerland | 271/95 |
| 688469 | 3/1953 | United Kingdom . | |
| 1012970 | 12/1965 | United Kingdom | 271/95 |
| 1033930 | 6/1966 | United Kingdom | 271/95 |
| 1295520 | 11/1972 | United Kingdom | 271/95 |

*Primary Examiner*—H. Grant Skaggs
*Assistant Examiner*—Carol L. Druzbick
*Attorney, Agent, or Firm*—Sughrue, Mion, Zinn, Macpeak & Seas

[57] ABSTRACT

1. Apparatus for the storage and extraction of blanks (10) consisting of thin cardboard from a blank magazine (12).

2.1. An extraction unit (16) having a sun wheel (17) and planet wheels (18, 19) rotating about the latter serves for the continuous extraction of blanks (10) consisting of thin cardboard from a blank magazine (12). Each planet wheel (18, 19) rotating about its own axis extracts a lower blank (10) of a blank stack (11) in the blank magazine (12) and transfers this onto the sun wheel (17). The blank is transferred from the latter, in conjunction with a transport disc (51, 52), into a blank track (14).

2.2. The sun wheel (17) and the planet wheels (18, 19) grasp the blanks (10) solely in a middle region, namely in the region of a blank middle strip (46), with the exclusion of lateral folding tabs (39, 40; 41, 42).

14 Claims, 5 Drawing Sheets

APPARATUS FOR THE STORAGE AND EXTRACTION OF BLANKS

DESCRIPTION

Figure 1:
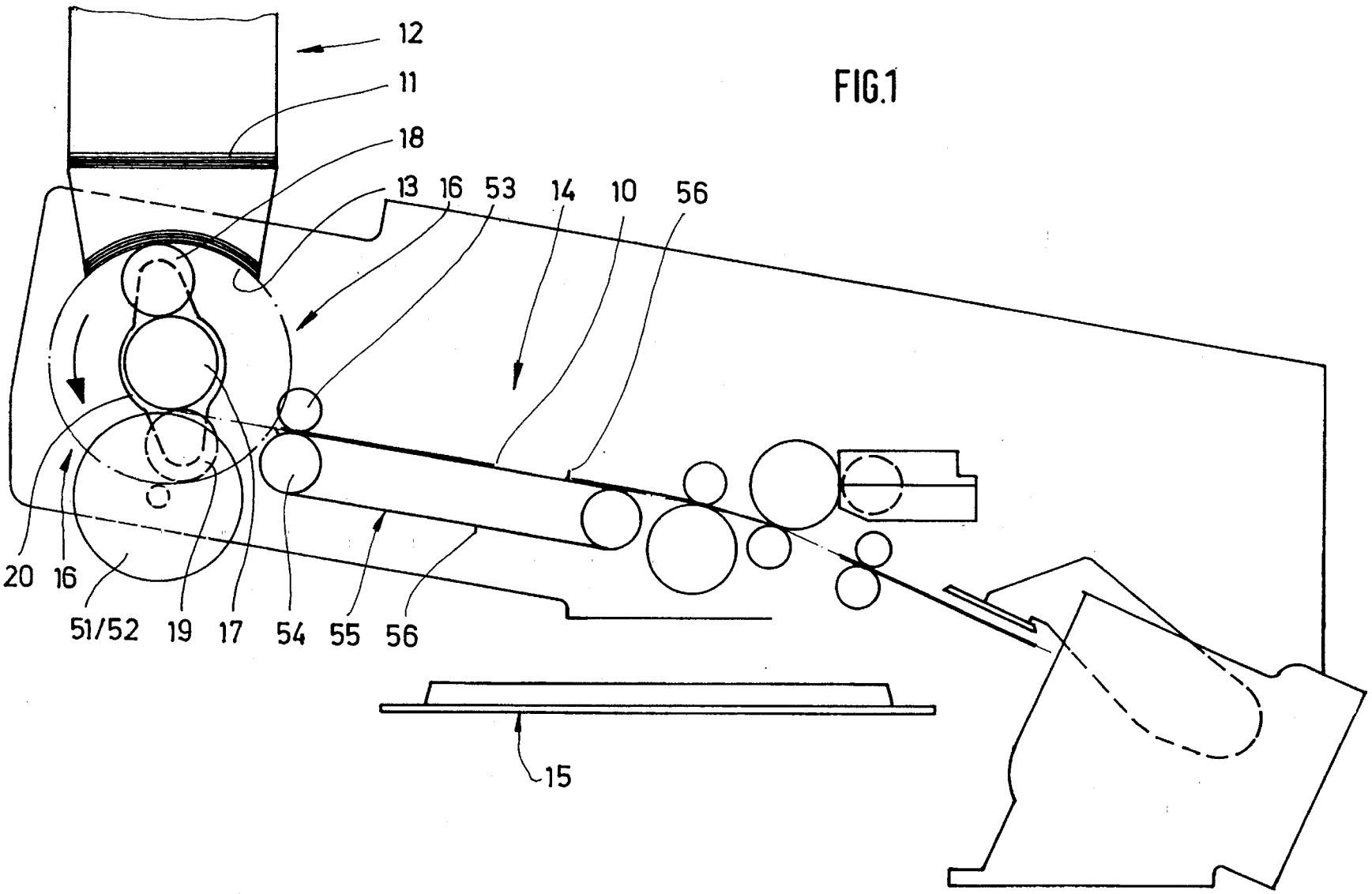

The invention relates to an apparatus for the storage of a stock of blanks consisting of thin cardboard for hinge-lid packs and for the extraction of individual blanks, a blank stack being received in a blank magazine having a lower extraction orifice and downwardly converging lateral conveying members, in such a way that the lower blanks of the blank stack are supplied in a concavely curved position and are extracted by an extraction member having a plurality of rotatable planet wheels and a sun wheel cooperating with these and are transported away by the sun wheel.

An apparatus of this type is known from DE-2,436,354. In this version, the rotatable sun wheel of fixed location is assigned two planet wheels located opposite one another. These respectively grasp the lower blank of the blank stack with their circumferential surface. For this purpose, suction bores are arranged on the circumference of the planet wheels. During the further rolling movement, the blank bearing on the outer surface of the planet wheel is transferred onto the circumference of the sun wheel and is delivered to a discharge-conveyor track by the latter.

In an exemplary embodiment of this known apparatus, the lateral conveying members limiting the blank magazine in the lower region are designed as downwardly converging conveyor bands. These grasp the blanks in the region of their narrow end edges, in the middle region of these, that is to say at edges of a front wall, on the one hand, and of a lid inner tab of the blank, on the other hand. The planet wheels, and correspondingly the sun wheel, are designed as two suction discs which are arranged at a distance from one another and which grasp the blank respectively only in the region of lateral folding tabs. Since, in a conventional blank for hinge-lid packs, the lateral folding tabs are divided off from one another by a plurality of longitudinally and transversely extending severing cuts, it is difficult to hold the blanks sufficiently against curved or cylindrical bearing surfaces and to transport them. For this reason, the known apparatus has proved unsuccessful in practice.

The object on which the invention is based is to develop further and improve the apparatus explained in the introduction, to the effect that the blanks, when being extracted from the blank magazine by the planet wheels and during further transport, undergo a more exact and fault-free guidance, with the particular shaping of the lateral folding tabs being taken into account.

To achieve this object, the apparatus according to the invention is characterized in that the planet wheels respectively grasp a blank with their circumferential surfaces solely in a middle bearing region between the lateral folding tabs, namely in the region of a blank middle strip.

The sun wheel and a further discharge-conveyor member, namely a discharge-conveyor wheel, active according to the invention also come to bear on the blanks solely in the region of the blank middle strip, without contact with the lateral folding tabs. This results in a fault-free transport of the blanks, since the lateral folding tabs are not grasped by the conveying members. The downwardly converging conveying members of the blank magazine also grasp the blanks at end edges solely in the region of the blank middle strip.

In the apparatus according to the invention, the planet wheels are designed so that, during the movement to extract a blank from the blank magazine, a collision with the conveying members, especially with lateral supporting bands, is avoided. For this purpose, the planet wheels are provided with radial depressions between holding regions grasping the blanks.

Further features of the invention relate to the design of the gear for the cycle of movement of the sun wheel, of the planet wheels and of the conveying disc.

Figure 2:
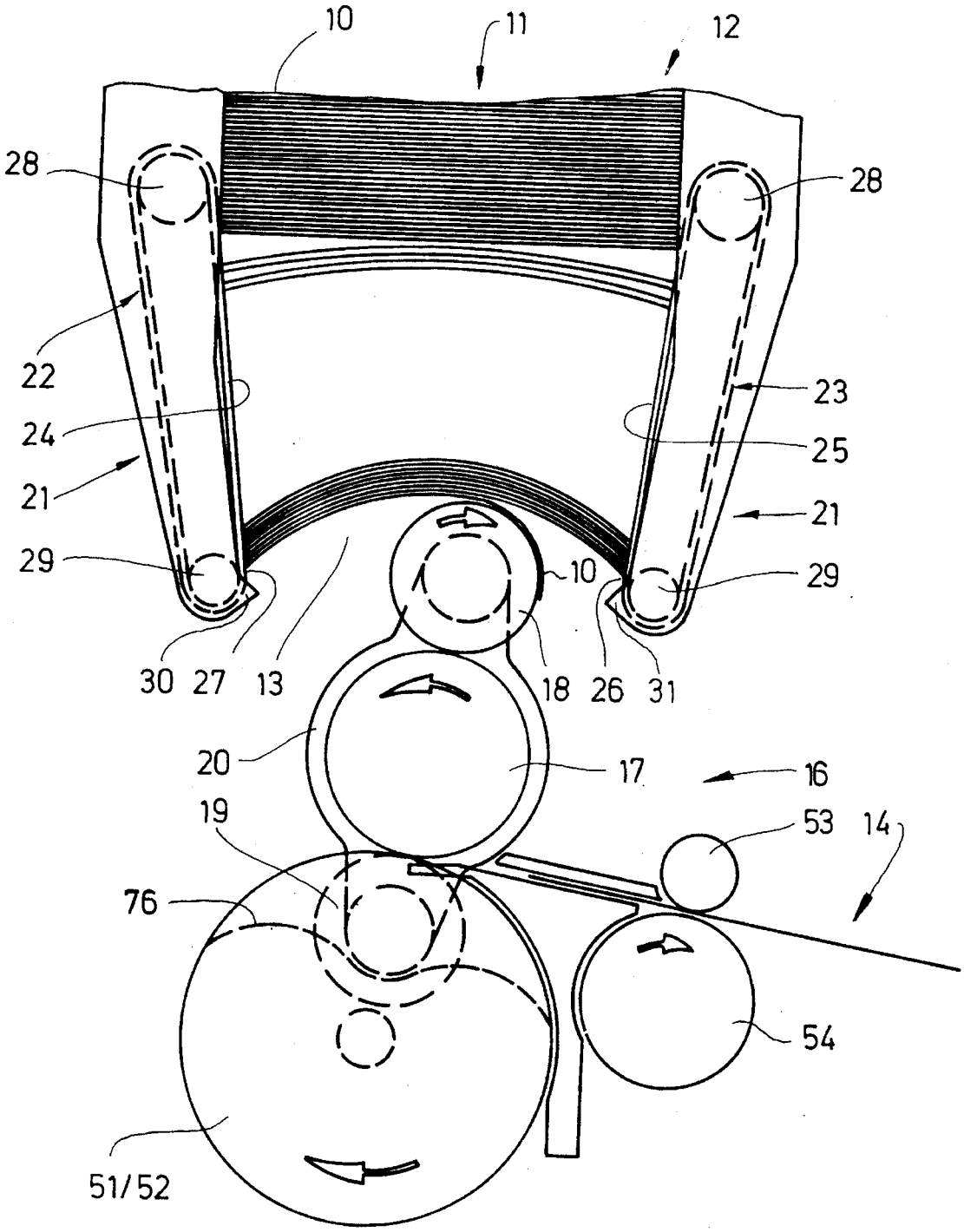
Figure 3:
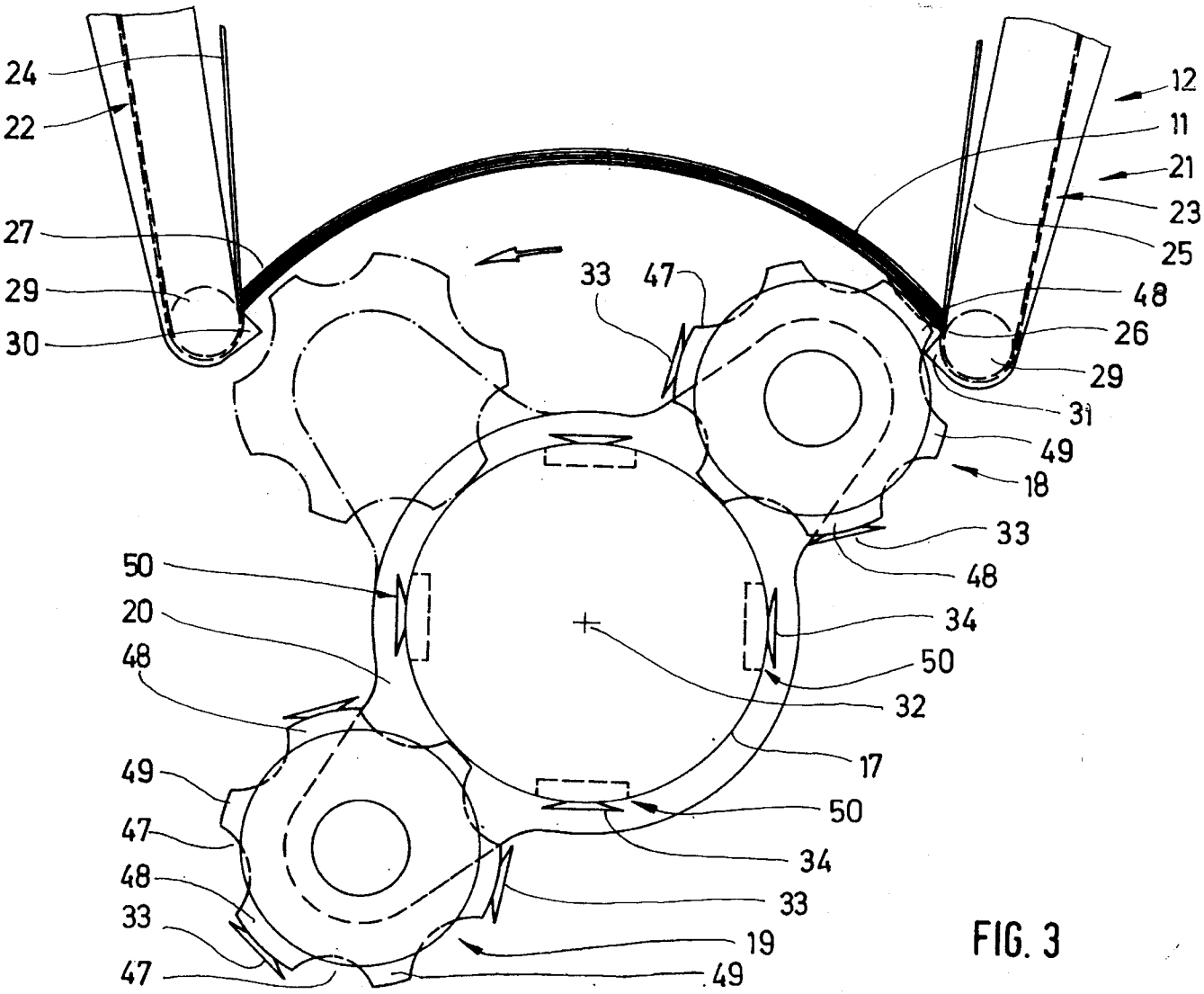
Figure 4:
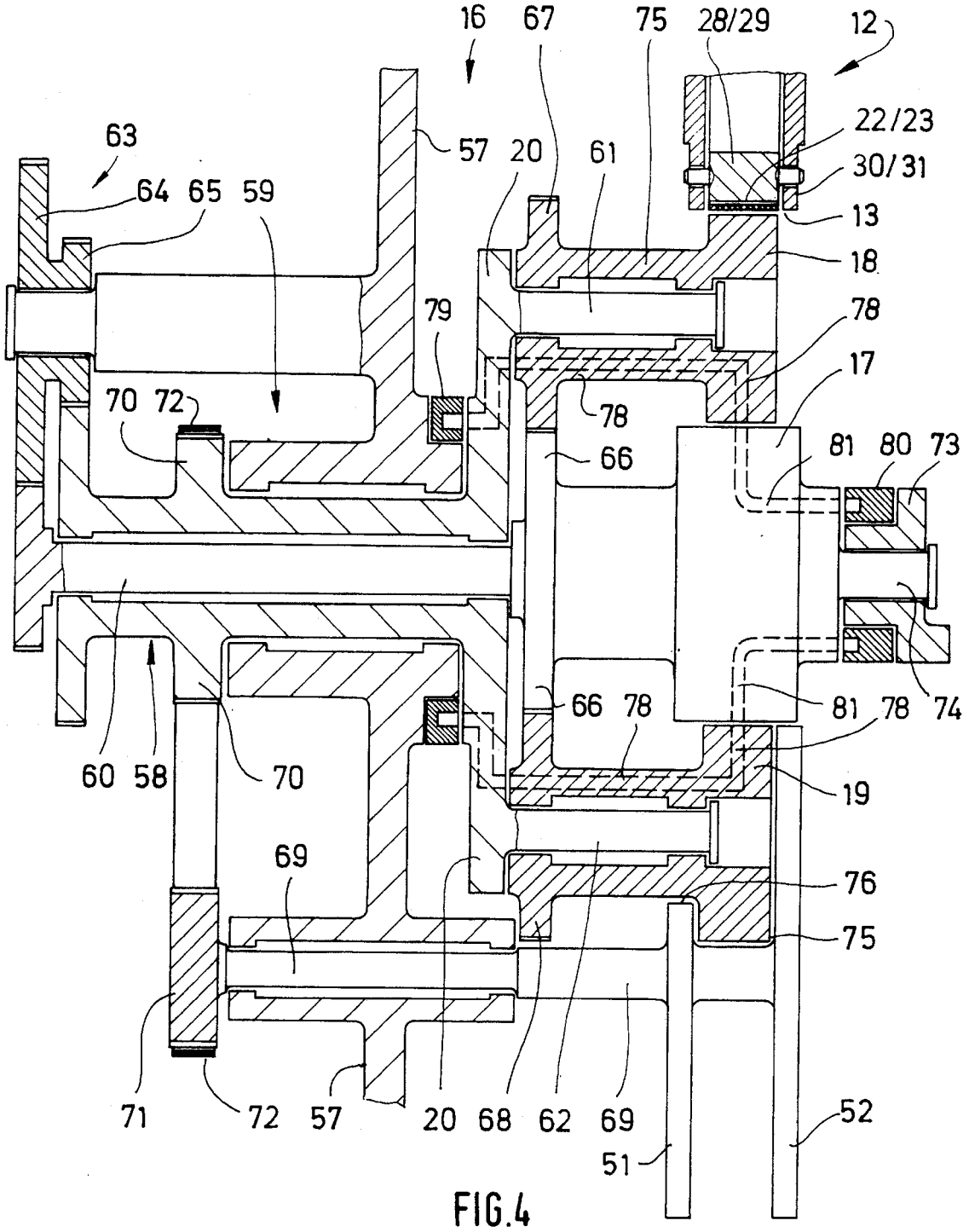
Figure 5:
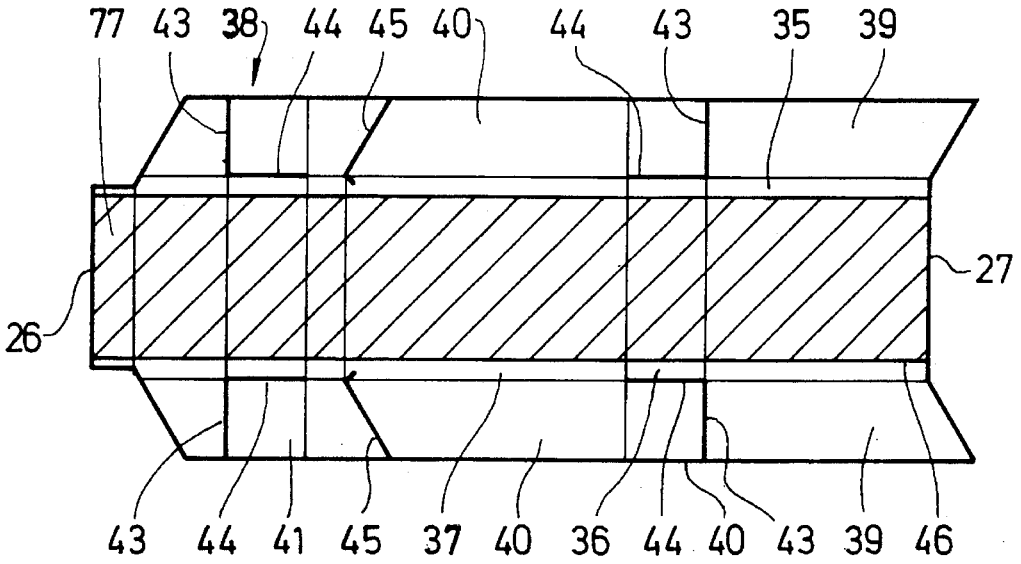
Figure 6:
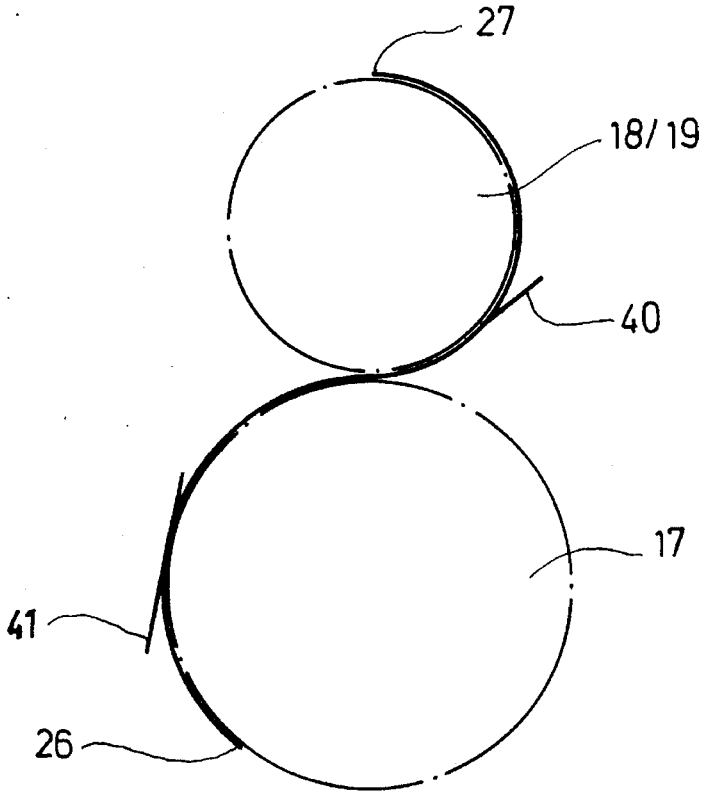

An exemplary embodiment of the apparatus according to the invention is explained in more detail below by means of the drawings. In these:

FIG. 1 shows a diagrammatic side view of a blank magazine with an extraction apparatus for the blanks and of part of a packaging machine, FIG. 2 likewise shows a side view of a lower part of the blank magazine with an extraction apparatus on an enlarged scale, FIG. 3 likewise shows a side view of a sun wheel and planet wheels as part of the extraction apparatus on a scale further enlarged, FIG. 4 shows a vertical section through the extraction apparatus including the gear, FIG. 5 shows a blank for hinge-lid packs in a spread-out position, FIG. 6 shows a diagrammatic representation of the transfer of a blank according to FIG. 5 from a planet wheel to the sun wheel.

The exemplary embodiment illustrated in the drawings is concerned with the handling of blanks 10 consisting of thin cardboard, specifically, in actual fact, those for the production of hinge-lid packs for receiving cigarettes. A stock of such blanks, namely a blank stack 11, is received in a vertical blank magazine 12. This is provided on the underside with an extraction orifice 13. The respective lower blank 10 of the blank stack 11 is extracted from the blank magazine 12 via the extraction orifice 13 and is delivered to the packaging machine via a blank track 14. In the present exemplary embodiment according to FIG. 1, the blank track 14 inclined downwards in the conveying direction is located above a plate-shaped folding turret 15 having a vertical axis of rotation. The blanks 10 are conveyed successively into pockets of this folding turret.

An extraction unit 16 serves for extracting the blanks 10 from the blank magazine 12. This extraction unit 16 consists of a sun wheel 17 rotatably mounted at a fixed location, that is to say central, and a plurality of, in the present exemplary embodiment two, planet wheels 18, 19. These rotate at a continuous speed about the sun wheel 17 and additionally about their own axis. The planet wheels 18, 19 located diametrically opposite one another are arranged on a carrier rotating coaxially with the sun wheel 17, namely on a rotor 20.

The blanks 10 stacked in an exact relative position are brought into a concavely curved shape, with a radius of curvature decreasing downwards, in the region of a lower extraction portion 21 by the exertion of pressure on end edges. The arrangement is such that the respective lower blanks 10 are shaped (approximately) in the form of an arc of a circle according to an outer enveloping curve, that is to say according to an outer path of movement of the planet wheels 18, 19.

For this purpose, the blanks 10 are moved downwards, in the region of the extraction portion 21, by downwardly converging conveying members, namely by supporting bands 22, 23. Their mutually confronting conveying strands 24, 25 serve for supporting end edges 26, 27 of the blanks 10. The supporting bands 22, 23 are driven in a downwardly directed conveying movement, specifically preferably at a speed which is approximately 10% higher than that of the conveying movement of the blank stack 11 directed towards the extraction orifice 13. The supporting bands 22, 23 are designed as toothed belts and are guided and driven by deflecting rollers 28, 29. The inclination of the conveying strands 24, 25 is approximately 6 relative to the vertical.

Arranged directly in the region of the extraction orifice 13 is a separate supporting member for the blanks 10, namely stationary noses 30, 31. These form a supporting face for the end edges 26 and 27 of the blanks 10.

For the extraction of blanks 10, the planet wheels are moved about a central axis of rotation 32 of the sun wheel 17 by means of a corresponding rotary drive of the rotor 20. At the same time, the planet wheels 18, 19 rotate about their own axis. The relative movements are coordinated with one another in such a way that holding members for the blanks 10, in the present exemplary embodiment suckers 33 or suction bores, arranged on the circumference of the planet wheels 18, 19 respectively grasp a blank 10 on the end region of the latter, namely adjacent to the end edge 26. The drive is designed so that the rotor 20 together with the planet wheels 18, 19 rotates in the anti-clockwise direction. The planet wheels 18, 19 themselves rotate in the clockwise direction.

During the further rotational movement of the rotor 20, the blank 10 grasped by the planet wheel 18 is laid onto the circumference of the planet wheel 18 as a result of the independent rotation of the latter. Finally, the blank end grasped first (adjacent to the end edge 26) passes onto the circumference of the sun wheel 17 and is likewise grasped by this by means of holding members, namely suckers 34. A simultaneous removal of air from the suckers 33 of the planet wheel 18 ensures that the blank 10 is now gradually taken over by the sun wheel 17.

The blanks 10 shown here for hinge-lid packs have a characteristic construction which emerges from FIG. 5. A middle blank part is formed essentially by a front wall 35, an adjoining bottom wall 36 and a rear wall 37. Corresponding blank parts of a lid 38 adjoin these. Lateral regions of the blank 10 consist of folding tabs, namely side tabs 39 and 40 arranged on both sides of the middle part and corner tabs 42, 41. These folding tabs belonging to a standard blank 10 are subdivided by transversely directed severing cuts 43 as well as by longitudinal cuts 44 and by oblique cuts 45. These variously directed cuts lead to a behavior of the folding tabs 39 . . 42 which presents problems when the blank 10 is brought into an arcuate form. FIG. 6 shows a S-shaped formation of the blank 10 during a phase in the transfer from a planet wheel 18, 19 onto the circumference of the sun wheel 17. As is evident, parts of folding tabs, especially the corner tabs 41, 42, are directed tangentially.

In order to avoid the risk of damage to the blanks 10 which is caused thereby, the effective members of the blank magazine 12 and of the extraction unit 16 engage on the blank 10 solely in a middle region, but at all events not in the region of the lateral folding tabs 39 . . 42. In FIG. 5, a blank middle strip 46 is designated by hatching. This forms the bearing region of the members of the blank magazine 12 and extraction unit 16 and terminates on both sides at a distance from the lateral folding tabs.

The planet wheels 18, 19 are designed in a special way, in order, during the extraction of blanks 10 from the blank magazine 12, to avoid collision with the supporting bands 22, 23 and the noses 30, 31. For this purpose, trough-shaped depressions 47 are formed along the circumference of the planet wheels 18, 19. These depressions 47 extend in an axis-parallel direction and at a distance from one another in the circumferential direction. The depressions 47 are arranged so that the lower end of the extraction portion 21, namely the deflecting rollers 29 together with the supporting bands 22, 23 and the noses 30, 31, penetrate respectively into a depression 47 when a planet wheel 18, 19 is moved past.

The depressions 47 limit holding portions 48 on the circumference of the planet wheels 18, 19. Arranged in the region of these holding portions 48 are suckers 33, preferably, in each case, a plurality located next to one another in the axial direction of the planet wheel 18, 19 and, if appropriate, in the circumferential direction. Instead of the abovementioned suckers 33, suction bores can also be formed here. The holding portion 48 is curved cylindrically, according to the outer circumference of the planet wheel 18, 19. In the present exemplary embodiment, each planet wheel 18, 19 is provided with three holding portions 48 which are arranged along the circumference at equal distances from one another. Located centrally between them are supporting webs 49 which likewise have a cylindrical outer face and which lie with this on the circumference of the planet wheel 18, 19. Here, the supporting webs 49 are without holding or suction members. A depression 47 is therefore located respectively between a holding portion 48 and a supporting web 49. The blank 10 received by a planet wheel 18, 19 is laid onto the outer face of the holding portions 48 and of the supporting webs 49.

The cylindrically designed sun wheel 17 is provided with a plurality of holding regions 50 arranged along the circumference at equal distances from one another. These are respectively equipped with a multiplicity of suckers 34 or suction bores, distributed in the axial direction, for the purpose of grasping the blank 10.

The blanks 10 conveyed in the circumferential direction by the sun wheel 17 are transported, on the (lower) side located opposite the blank magazine 12, into the blank track 14. For this purpose, a separate discharge-conveyor member cooperates with the sun wheel 17. This comprises one or two transport rollers or transport discs 51, 52 arranged at an axial distance from one another. These bear on the circumference of the sun wheel 17. The transport discs 51, 52 are driven in the conveying direction. The blank 10 is accordingly conveyed away, between the circumference of the sun wheel 17 and the transport discs 51, 52, into the blank track 14. Here, the blank 10 is first grasped by conveying rollers 53, 54 and moved further.

In order to synchronize the subsequent transport of the individual blanks with the work cycle of the packaging machine, according to the exemplary embodiment of FIG. 1 the conveying rollers 53, 54 are followed by an endless conveyor, namely a conveyor belt 55 which determines the distances between and the subsequent conveying speed of the blanks 10. For this purpose, the conveyor belt 55 is provided with drivers 56 which each grasp a blank 10 on the rear side.

All the members of the extraction unit 16 are moved by a central drive. For this purpose, the extraction unit 16 is mounted on part of a machine stand, namely on a (vertical) supporting wall 57. The disc-shaped rotor 20 is mounted rotatably in a bearing 59 of the supporting wall 57 by means of a hollow shaft 58. A drive shaft 60 for the sun wheel 17 extends in the hollow shaft 58. The planet wheels 18, 19 are mounted rotatably on axis-parallel supporting journals 61, 62 which are mounted on the rotor 20 so as to project on one side.

A central drive wheel 63 is driven by a motor (not shown). The drive wheel consists of two individual wheels 64, 65 (gearwheels) of differing diameter. The individual wheel 64 transmits rotational movements to the drive shaft 60. The individual wheel 65 is in drive connection with the hollow shaft 58.

The rotational movement of the planet wheels 18, 19 about their own axis is brought about by the drive shaft 60 of the sun wheel 17. A gearwheel 66 located on the drive shaft 60 is in engagement with mating wheels 67, 68 which are each assigned to a planet wheel 18, 19.

The transport discs 51, 52 are mounted on a common shaft 69. This is driven by the hollow shaft 58 by means of a gearwheel 70 in conjunction with a further gearwheel 71 on the shaft 69. The drive is transmitted between these by means of a toothed belt 72.

The free side of the extraction unit 16 is supported in a rotary bearing 73 of fixed location, specifically via a supporting journal 74 on the free side of the sun wheel 17.

The dimensions are selected so that the axial width of the sun wheel 17 or of the circumferential surface corresponds approximately to the width of the blank middle strip 46. The planet wheels 18, 19 designed with a clearly smaller width are located centrally relative to the sun wheel 17 and also to the blank magazine 12. The transport discs 51, 52 are arranged at such a distance from one another that, during the rotational movement, a planet wheel 18, 19 can temporarily be received between the transport discs 51, 52. So that a cylindrical supporting sleeve 75 of the planet wheels 18, 19 can be moved past the inner transport disc 51 without contact during the rotational movements, the latter is provided with a recess 76 located on one side. The size and shape of this recess 76 conform to the cycle of movement of the planet wheels 18, 19 or of the supporting sleeve 75. The maximum distance between the transport discs 51, 52 is likewise no greater than the width of the blank middle strip 46.

The supporting bands 22, 23 of the blank magazine and the noses 30, 31 are also designed with such a width and are so arranged that they are active solely in the region of the blank middle strip 46. The dimension of the supporting bands corresponds to the width of the planet wheels 18, 19.

The holding members for the blanks, in the present case suckers 33, 34, mounted in the region of the sun wheel 17 and of the planet wheels 18, 19 are supplied with a vacuum in a way known per se. A suction line 78 for suction bores or suckers 33 of the planet wheels 18, 19 leads from a stationary channel ring 79 via the supporting sleeve 75, rotating together with the planet wheel 18, 19, to the circumferential surface of the planet wheel 18, 19.

The suckers 34 of the sun wheel 17 are supplied by a likewise stationary channel ring 80 which is arranged in the region of the stationary rotary bearing 73. A suction line 81 leads from this channel ring 80, within the sun wheel 17, to the circumferential surface of the latter.

We claim:

1. In an apparatus for storage of a stock of blanks, consisting of thin cardboard, for hinge-lid packs and for the extraction of individual blanks (10), wherein a blank stack (11) is received in a blank magazine (12), having a lower extraction orifice (13) and a plurality of downwardly converging lateral conveying members, in such a way that lower blanks (10) of the blank stack (11 ) are supplied in a concavely curved position and are extracted by an extraction unit (16) having a plurality of rotatable planet wheels (18, 19) and a sun wheel (17) cooperating with the planet wheels (18, 19), and wherein said lower blanks (10) are transported away by the sun wheel (17), the improvement wherein:

said planet wheels ( 18, 19) have circumferential surfaces which respectively grasp a blank (10) only in a region of a middle strip (46) of the blank between lateral folding tabs (39, 40; 41, 42) thereof;

also in a region of said sun wheel (17), only said blank middle strip (46) of each of the blanks (10) bears on a circumference of said sun wheel (17); and said apparatus further comprises a rotating discharge-conveyor member, for transporting away the blanks, including two transport discs (51, 52) that are arranged at an axial distance from one another and bear on said circumference of said sun wheel (17) to convey away a blank (10).

2. The apparatus according to claim 1, wherein said blank magazine (12) comprises lateral supporting conveying-bands (22, 23) for supporting blanks (10), and stationary supporting members (30, 31) for supporting tile blanks, said conveying-bands and said supporting member supporting the blanks (10) only in a middle region of end edges (26, 27) of the blank (10).

3. The apparatus according to claim 1, wherein, in a lower position, said planet wheels (18, 19) pass respectively into a region between the transport discs (51, 52) arranged at a corresponding distance front one another but wherein a maximum distance between said transport discs (51, 52) is no greater than a width of said blank middle strip (46).

4. The apparatus according to claim 3, wherein an inner one (51) of said transport discs has a recess (76) into which a supporting sleeve (75) of said planet wheels (18, 19) passes during a phase of rotational movement.

5. In an apparatus for storage of a stock of blanks, consisting of thin cardboard, for hinge-lid packs and for the extraction of individual blanks (10), wherein a blank stack (11) is received in a blank magazine (12), having a lower extraction orifice (13) and a plurality of downwardly converging lateral conveying members, in such a way that lower blanks (10) of the blank stack (11) are supplied in a concavely curved position and are extracted by an extraction unit (16) having a plurality of rotatable planet wheels (18, 19) and a sun wheel (17) cooperating with the planet wheels (18, 19), and wherein said lower blanks (10) are transported away by the sun wheel (17), the improvement wherein:

said planet wheels (18, 19) have circumferential surfaces which respectively grasp a blank (10) only in a region of a middle strip (46) of the blank between lateral folding tabs (39, 40; 41, 42) thereof;

also in a region of said sun wheel (17), only said blank middle strip (46) of each of the blanks (10) bears on a circumference of said sun wheel (17); and each of said sun wheel (17) and said planet wheels (18, 19) is an individual roller, wherein an axial width of said sun wheel corresponds approximately to a width of said blank middle strip (46), and wherein said planet wheels (18, 19) are arranged centrally relative to said sun wheel (17) and have a smaller width in the axial direction.

6. In an apparatus for storage of a stock of blanks, consisting of thin cardboard, for hinge-lid packs and for the extraction of individual blanks (10), wherein a blank stack (11) is received in a blank magazine (12), having a lower extraction orifice (13) and a plurality of downwardly converging lateral conveying members, in such a way that lower blanks (10) of the blank stack (11) are supplied in a concavely curved position and are extracted by an extraction unit (16) having a plurality of rotatable planet wheels (18, 19) and a sun wheel (17) cooperating with the planet wheels (18, 19), and wherein said lower blanks (10) are transported away by the sun wheel (17), the improvement wherein:

said planet wheels (18, 19) have a plurality of holding portions (48), distributed in a circumferential direction, for grasping and holding a blank (10) only in a region of a middle strip (46) of the blank; and between said holding portions (48) are formed radial depressions (47) which, during a rotational and circling movement, function, as a result of relative positions of said planet wheels (18, 19), to receive lower ends of supporting bands (22, 23) and supporting members (30, 31) of the blank magazine (12).

7. The apparatus according to claim 6, wherein each of said holding portions (48) has a cylindrical bearing face for the blank (10), and has a holding sucker (33).

8. The apparatus according to claim 6, wherein each of said planet wheels comprises a plurality of supporting webs (49), each disposed between adjacent ones of at least three of said holding portions (48), and each having a cylindrical outer face, said webs (49) being located at equal distances from one another, the depressions (47) each being located between a holding portion (48) and a supporting web (49).

9. The apparatus according to claim 6, wherein said sun wheel (17) has, distributed along a circumference thereof, holding regions (50) for the blanks, the holding regions (50) corresponding to said holding portions (48) of said planet wheels (18, 19) in a region of a takeover of a blank (10) by a planet wheel (18, 19), and said holding regions (50) having holding suckers (34) for the blanks.

10. The apparatus according to claim 6, wherein a rotating discharge-conveyor member, the transporting away tile blanks, including two transport discs (51, 52) that are arranged at an axial distance from one another and bear on said circumference of said sun wheel (17) to convey away a blank (10).

11. The apparatus according to claim 10, wherein in a lower position, said planet wheels (18, 19) pass respectively into a region between the transport discs (51, 52) arranged at a corresponding distance from one another, but wherein a maximum distance between said transport discs (51, 52) is no greater than a width of said blank middle strip (46).

12. Apparatus according to claim 11, wherein an inner one (51) of said transport discs has a recess (76) into which a supporting sleeve (75) of said planet wheels (18, 19) passes during a phase of rotational movement.

13. The apparatus according to claim 6, wherein said extraction unit (16) is followed by a blank track (14)for the blanks (10), and comprising a conveyor belt (55) with drivers (56) for transporting the blanks over a first part of said track (14).

14. The apparatus according to claim 6, wherein each of said sun wheel (17) and said planet wheels (18, 19) is an individual roller, wherein an axial width of said sun wheel corresponds approximately to a width of said blank middle strip (46), and wherein said planet wheels (18, 19) are arranged centrally relative to said sun wheel (17) and have a smaller width in the axial direction.

* * * * *